US009552774B2

(12) United States Patent
Jeong et al.

(10) Patent No.: US 9,552,774 B2
(45) Date of Patent: Jan. 24, 2017

(54) ORGANIC LIGHT EMITTING DISPLAY DEVICE INCLUDING DATA DISTRIBUTION UNIT AND DRIVING METHOD THEREOF

(71) Applicant: SAMSUNG DISPLAY CO., LTD., Yongin, Gyeonggi-Do (KR)

(72) Inventors: Seon-I Jeong, Yongin (KR); Ki-Myeong Eom, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 371 days.

(21) Appl. No.: 13/927,057

(22) Filed: Jun. 25, 2013

(65) Prior Publication Data

US 2014/0240379 A1 Aug. 28, 2014

(30) Foreign Application Priority Data

Feb. 27, 2013 (KR) ..... 10-2013-0021529

(51) Int. Cl.
*G09G 3/32* (2016.01)
*G09G 3/20* (2006.01)

(52) U.S. Cl.
CPC ..... *G09G 3/3266* (2013.01); *G09G 3/2003* (2013.01); *G09G 3/3275* (2013.01);
(Continued)

(58) Field of Classification Search
CPC ... G09G 3/2003; G09G 3/3291; G09G 3/3266
(Continued)

(56) References Cited

U.S. PATENT DOCUMENTS

2004/0140983 A1* 7/2004 Credelle ..... G09G 3/2003 345/613
2008/0055304 A1 3/2008 Ryu et al.
(Continued)

FOREIGN PATENT DOCUMENTS

EP 1 647 967 A1 4/2006
KR 10-0604060 B1 7/2006
(Continued)

OTHER PUBLICATIONS

Korean Patent Abstract of Publication No. 10-2006-0064219, published Jun. 13, 2006, which corresponds to Korean Patent Publication No. KR 10-0604060 B1, 1 page.
(Continued)

*Primary Examiner* — Jonathan Blancha
(74) *Attorney, Agent, or Firm* — Lewis Roca Rothgerber Christie LLP

(57) ABSTRACT

An organic light emitting diode (OLED) display includes: a display unit comprising a plurality of data lines, a plurality of scan lines, and a plurality of pixels coupled to corresponding data lines of the data lines and corresponding scan lines of the scan lines; a scan driver configured to supply a plurality of scan signals to the scan lines; a data driver configured to: output a plurality of first data signals among a plurality of data signals through a plurality of first output lines among a plurality of output lines, output a plurality of second data signals among the data signals through the first output lines, and output a plurality of third data signals among the data signals through a plurality of second output lines among the output lines, wherein the first data signals represent a first color, the second data signals represent a second color, and the third data signals represent a third color; and a data distribution unit configured to: transmit the first data signals to a plurality of corresponding first data lines among the data lines according to a first clock signal,
(Continued)

transmit the second data signals to a plurality of corresponding second data lines among the data lines according to a second clock signal, and transmit the third data signals to a plurality of corresponding third data lines among the data lines.

19 Claims, 15 Drawing Sheets

(52) U.S. Cl.
CPC ... *G09G 3/3291* (2013.01); *G09G 2310/0262* (2013.01); *G09G 2310/0297* (2013.01)

(58) Field of Classification Search
USPC ..... 345/691
See application file for complete search history.

(56) References Cited

U.S. PATENT DOCUMENTS

2008/0062089 A1 3/2008 Kim et al.
2009/0262048 A1* 10/2009 Park ..... G09G 3/006 345/76
2012/0098871 A1 4/2012 Park et al.
2013/0082915 A1* 4/2013 Nakagawa ..... G09G 3/3688 345/92
2013/0141320 A1* 6/2013 Kim ..... G09G 3/3685 345/92
2014/0191931 A1* 7/2014 Kim ..... G09G 3/3291 345/76
2014/0307004 A1* 10/2014 Roh ..... G09G 3/3266 345/690

FOREIGN PATENT DOCUMENTS

KR 10-0784014 B1 12/2007
KR 10-2008-0041526 A 5/2008
KR 10-0924143 B1 10/2009
TW I251798 3/2006
TW 201324491 A1 6/2013

OTHER PUBLICATIONS

Korean Patent Abstract of Application No. 10-2006-0034616, dated Apr. 17, 2006, which corresponds to Korean Patent Publication No. KR 10-0784014 B1, 1 page.
Korean Patent Abstract of Publication No. 10-2008-0030904, dated Apr. 2, 2006, which corresponds to Korean Patent Publication No. KR 10-0924143 B1, 1 page.
European Search Report for Application No. 13179347.3, dated Dec. 3, 2013, 15 pages.
TIPO Office Action dated Nov. 7, 2016, for corresponding Taiwanese Patent Application No. 102128624 (9 pages).

* cited by examiner

ORGANIC LIGHT EMITTING DISPLAY DEVICE INCLUDING DATA DISTRIBUTION UNIT AND DRIVING METHOD THEREOF

CROSS-REFERENCE TO RELATED APPLICATION

This application claims priority to and the benefit of Korean Patent Application No. 10-2013-0021529 filed in the Korean Intellectual Property Office on Feb. 27, 2013, the entire contents of which are incorporated herein by reference.

BACKGROUND (a) Field

Embodiments of the present invention relate to an organic light emitting diode (OLED) display and a driving method thereof.

(b) Description of the Related Art

In general, with respect to flat panel displays, there are a liquid crystal panel display, a field emission panel display, a plasma display panel (PDP), and an organic light emitting diode (OLED) display.

Among the flat organic light emitting diode (OLED) displays, the organic light emitting diode (OLED) display using an organic light emitting diode (OLED) means a flat display using an electro-luminescence phenomenon of an organic material. The organic light emitting diode emits light using a mechanism in which electrons and holes are injected from electrodes and the injected electrons and holes are combined to have an excitation state.

The organic light emitting diode display can have reduced volume and weight because an additional light source is not required, and it may be used for an electronic product such as a portable terminal or a large-sized television with characteristics such as relatively low power consumption, high luminous efficiency, high luminance, and a wide viewing angle, as well as a fast response speed.

The organic light emitting diode (OLED) display includes a data driver transmitting a data signal to a plurality of data lines, a scan driver sequentially transmitting a scan signal to a plurality of scan lines, and a plurality of pixels coupled to a plurality of scan lines and a plurality of data lines. Each pixel supplies a current corresponding to the corresponding data signal to the organic light emitting diode (OLED), and the organic light emitting diode (OLED) emits light according to the supplied current amount.

When increasing the number of pixels to improve the resolution of the organic light emitting diode (OLED) display, a plurality of pixels coupled to one scan line are coupled to different data lines such that the number of data lines is proportionally increased. Accordingly, the circuit of the data driver may be relatively complicated and the manufacturing costs of the data driver may be relatively high.

To reduce the complexity and manufacturing costs of the data driver, a demultiplexer may be utilized, which selectively outputs one input signal to one among a plurality of output lines. That is, by sequentially applying the data signal output from the data driver to a plurality of data lines through the demultiplexer of a 1:n method, the circuit of the data driver may be simplified.

As described above, for the organic light emitting diode (OLED) display using the demultiplexer, to prevent the data signal input to each pixel during current horizontal period from being influenced by the data signal applied during the previous horizontal period, each horizontal period is divided into a writing period in which the data signal is written and a scan period in which the data signal is transmitted to each pixel according to the scan signal.

However, as the organic light emitting diode (OLED) display is developed with higher resolution, a horizontal period is decreased such that the writing of the data to all pixels through the 1:n demultiplexer is limited. For this, when increasing the data writing period, the scan period is relatively shortened. Accordingly, the data compensation time is shortened such that spots may be generated in the display.

The above information disclosed in this Background section is only for enhancement of understanding of the background of the invention and therefore it may contain information that does not form the prior art that is already known in this country to a person of ordinary skill in the art.

SUMMARY

Accordingly, embodiments of the present invention provide an organic light emitting diode (OLED) display configured to obtain a sufficient data compensation time and also realize high resolution, and a driving method thereof.

An organic light emitting diode (OLED) display according to an exemplary embodiment of the present invention includes: a display unit comprising a plurality of data lines, a plurality of scan lines, and a plurality of pixels coupled to corresponding data lines of the data lines and corresponding scan lines of the scan lines; a scan driver configured to supply a plurality of scan signals to the scan lines; a data driver configured to: output a plurality of first data signals among a plurality of data signals through a plurality of first output lines among a plurality of output lines, output a plurality of second data signals among the data signals through the first output lines, and output a plurality of third data signals among the data signals through a plurality of second output lines among the output lines, wherein the first data signals represent a first color, the second data signals represent a second color, and the third data signals represent a third color; and a data distribution unit configured to: transmit the first data signals to a plurality of corresponding first data lines among the data lines according to a first clock signal, transmit the second data signals to a plurality of corresponding second data lines among the data lines according to a second clock signal, and transmit the third data signals to a plurality of corresponding third data lines among the data lines.

A horizontal period may include a writing period in which a corresponding voltage of the first to third data signals are respectively stored in first to third capacitive elements, and a scan period in which the corresponding voltage of the first to third data signals stored in the first to third capacitive elements are transmitted to the corresponding data lines, and the data driver may be further configured to: sequentially output the first data signal and the second data signal during the writing period, and output the third data signal to overlap with at least one of the first data signal or the second data signal.

The OLED display may further include a signal controller configured to output the first and second clock signals having sequential activation periods, respectively, during the writing period.

The signal controller may be configured to output the first clock signal and the second clock signal such that an activation period of the first clock signal does not overlap with an activation period of the second clock signal.

Each frame may include an even-numbered frame and an odd-numbered frame, and the signal controller is configured to output the first clock signal having an activation period of the even-numbered frame that is different from and an activation period of the odd-numbered frame.

The signal controller may be configured to output the second clock signal having an activation period of the even-numbered frame that is different from an activation period of the odd-numbered frame.

The signal controller may be configured to output a third clock signal having an activation period overlapping an activation period of at least one of the first clock signal and the second clock signal during the writing period.

The data distribution unit may be configured to transmit the third data signal to the third data lines according to the third clock signal.

The data distribution unit may include first and second switches configured to be turned on according to the first and second clock signals, respectively, to selectively couple the first output line to one of the corresponding first and second data lines.

The data distribution unit may include a third switch configured to be turned on according to the third clock signal to selectively couple the second output line to the corresponding third data line.

Each of the pixels may include: a first subpixel configured to emit light according to the first data signal, a second subpixel configured to emit light according to the second data signal, and a third subpixel configured to emit light according to the third data signal; and a plurality of scan lines comprising: a plurality of first scan lines coupled to the first and second subpixels, and a plurality of second scan lines coupled to the third subpixel.

The third subpixel may be configured to emit a green-colored light, and the scan driver may be configured to output a scan-on period of the second scan signal supplied to the second scan line, wherein the scan-on period of the second scan signal is longer than a scan-on period of the first scan signal supplied to the first scan line.

The signal controller may be configured to delay an output of the third clock signal with respect to the first clock signal by a difference between a duration of the scan-on period of the first scan signal and a duration of the scan-on period of the second scan signal.

A method of driving an organic light emitting diode (OLED) display according to another exemplary embodiment, the OLED display including: a display unit including a plurality of data lines, a plurality of scan lines, and a plurality of pixels coupled to corresponding ones of the data lines and corresponding ones of the scan lines, a scan driver configured to supply a plurality of scan signals to the scan lines, and a data driver configured to output a plurality of data signals respectively corresponding to the pixels to a plurality of output lines, the method comprising: sequentially outputting a first data signal representing a first color and a second data signal representing a second color to first output lines among the plurality of output lines; outputting a third data signal representing a third color to second output lines among the plurality of output lines; transmitting the first data signal to first data lines among the plurality of data lines according to a first clock signal; transmitting the second data signal to the second data lines among the plurality of data lines according to a second clock signal; and transmitting the third data signal to third data lines among the plurality of data lines.

The third data signal may overlap with one of the first and second data signals.

A horizontal period may include: a writing period in which a voltage of each of the first to third data signals are respectively stored in first to third capacitive elements, and a scan period in which the voltages stored to the first to third capacitive elements are transmitted to corresponding data lines, and the method may further include sequentially outputting the first and second clock signals during the writing period.

In the outputting of the first and second clock signals, activation periods of the first and second clock signals may not overlap each other.

The method may further include outputting a third clock signal comprising an activation period that overlaps one of the first and second clock signals during the writing period.

The organic light emitting diode (OLED) display and the driving method according to an exemplary embodiment of the present invention writes the data signal to each pixel by using the 2:n demultiplexer such that relatively high resolution may be realized and sufficient data compensation time may be obtained.

Also, an exemplary embodiment of the present invention provides an effect of reducing the size of the IC to drive each pixel and a dead space under the panel.

An exemplary embodiment of the present invention also obtains a spot compensation time for the green subpixel.

DETAILED DESCRIPTION

Figure 1:
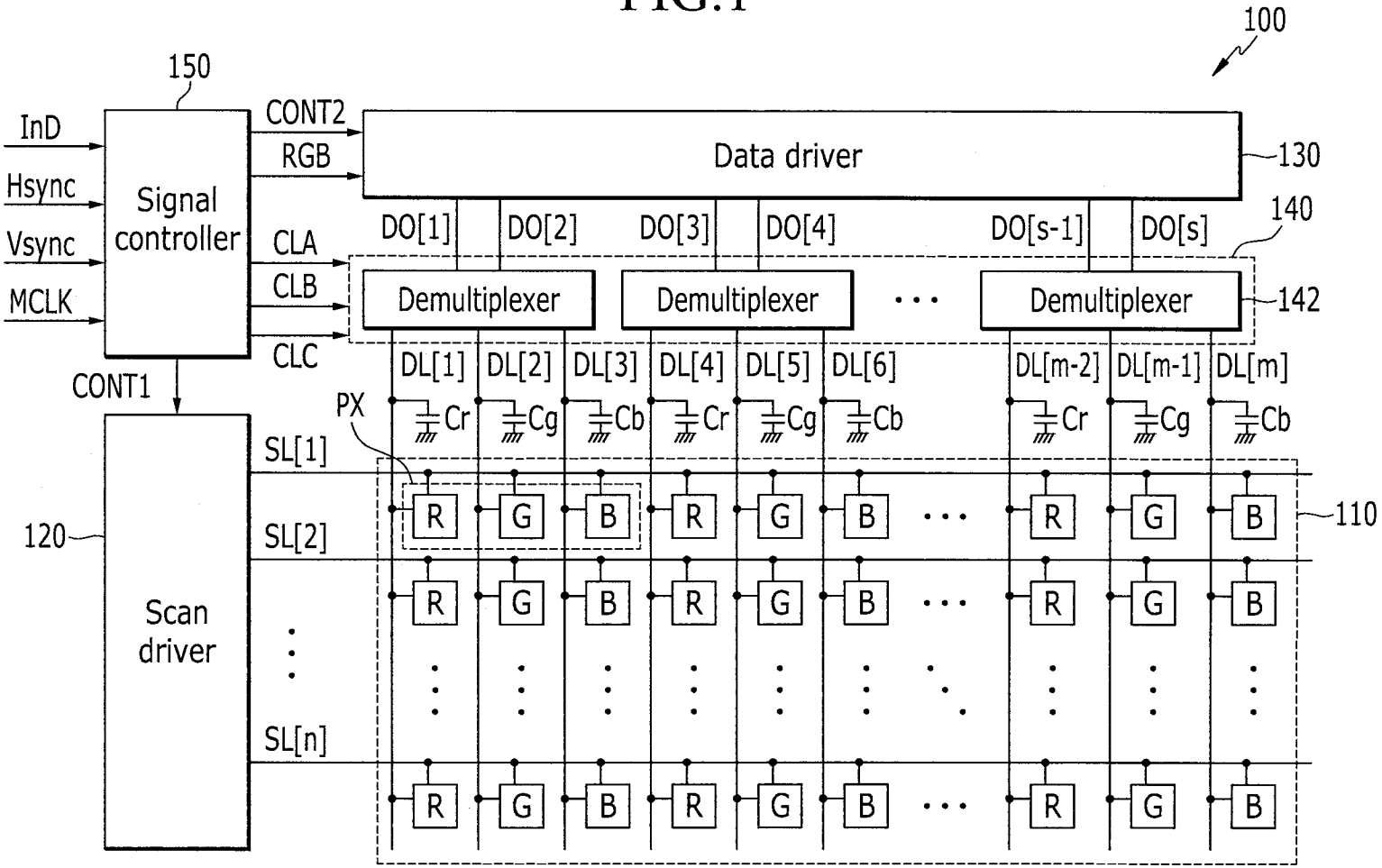
FIG. 1 is a view of an organic light emitting diode (OLED) display according to the first exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, this includes a case where the element is "directly coupled" to another element and a case where the element is "electrically connected" to another element with a further element interposed therebetween. In addition, unless explicitly described to the contrary, the word "comprise" and variations such as "comprises" or "comprising" will be understood to imply the inclusion of stated elements but not the exclusion of any other elements.

Next, an exemplary embodiment of the present invention will be described with reference to accompanying drawings.

FIG. 1 is a view of an organic light emitting diode (OLED) display according to the first exemplary embodiment of the present invention.

Referring to FIG. 1, an organic light emitting diode (OLED) display 100 according to a first exemplary embodiment of the present invention includes a display unit 110, a scan driver 120, a data driver 130, a data distribution unit 140, and a signal controller 150. The display unit 110 has a display area including a plurality of pixels PX, and a plurality of scan lines SL[1]-SL[n] and a plurality of data lines DL[1]-DL[m]. Also, the first driving voltage VDD application line (not shown) and the second driving voltage (VSS) application line (not shown) are formed in the display unit 110.

The plurality of pixels PX respectively include a red subpixel R emitting red light, a green subpixel G emitting green light, a blue subpixel B emitting blue light. The red, green, and blue subpixels R, G, and B are sequentially coupled to the plurality of data lines DL[1]-DL[m] and emit light by a current supplied to the organic light emitting diode (OLED) according to a data signal transmitted from the data lines. An exemplary embodiment of the present invention is not limited thereto, and the kind or type, the number, and the disposition sequence of the subpixels forming the pixels PX may be changed.

The scan driver 120 is coupled to the plurality of scan lines SL[1]-SL[n] and generates the plurality of scan signals S[1]-S[n] according to a first driving control signal CONT1. The scan driver 120 transmits the scan signals S[1]-S[n] to the corresponding scan lines SL[1]-SL[n].

The data driver 130 processes image data RGB according to the second driving control signal CONT2 to be suitable for a characteristic of the display unit 110 to generate the plurality of data signals D[1]-D[m]. Here, the plurality of data signals D[1]-D[m] include a plurality of red data signals corresponding to the red subpixels R, a plurality of blue data signals corresponding to the blue subpixels B, and a plurality of green data signals corresponding to the green subpixels G.

The data driver 130 outputs the plurality of red, green, and blue data signals corresponding to the plurality of pixels PX through a plurality of output lines DO[1]-DO[s]. Here, the data driver 130 outputs at least two data signals among the plurality of red, green, and blue data signals through a plurality of first output lines among the plurality of output lines DO[1]-DO[s], and outputs the remaining data signals through a plurality of second output lines.

The data driver 130 according to the first exemplary embodiment of the present invention outputs the red data signals and the blue data signals through the first output lines, and outputs the green data signals through the second output lines.

The data driver 130 may sequentially output the red data signals and the blue data signals. Also, the data driver 130 may output the green data signals to have a period overlapping the red data signals or the blue data signals by a predetermined time. For example, a green data signal may be output during the same time as a corresponding red data signal, or may be output during a time in which the corresponding red data signal and a corresponding blue data signal are output.

That is, the data driver 130 may output the red and blue data signals to the first output lines and the green data signals to the second output lines such that corresponding red data signals and blue data signals are output sequentially, and the green data signals are output to overlap the corresponding red data signals or the blue data signals. An exemplary embodiment of the present invention is not limited thereto, and will be described through following exemplary embodiments.

The data distribution unit 140 is coupled between a plurality of output lines DO[1]-DO[s] and a plurality of data lines DL[1]-DL[m], and distributes a plurality of data signals D[1]-D[m] to a plurality of data lines DL[1]-DL[m] according to the first to third clock signals CLA, CLB, and CLC. Here, the plurality of data lines DL[1]-DL[m] include capacitive elements, for example capacitors Cr, Cg, and Cb to store the voltage corresponding to the red, green, and blue data signals.

The data distribution unit 140 according to an exemplary embodiment of the present invention sequentially transmits a plurality of red and blue data signals transmitted through the plurality of first output lines to a plurality of data lines coupled to the red and blue subpixels R and B among the plurality of data lines DL[1]-DL[m] according to the first and second clock signals CLA and CLB. Also, the data distribution unit 140 transmits the green data signal transmitted through the plurality of the second output lines to the plurality of data lines coupled to the green subpixel G among the plurality of data lines DL[1]-DL[m] according to a third clock signal CLC.

For this, the data distribution unit 140 includes a plurality of demultiplexers 142 respectively corresponding to the plurality of pixels PX. The plurality of demultiplexers 142 respectively couple two output lines to three data lines coupled to the red, green, and blue subpixels R, G, and B of the corresponding pixel PX according to the first to third clock signals CLA, CLB, and CLC.

The signal controller 150 receives external input data InD and a synchronization signal and generates the first and second driving control signals CONT1 and CONT2, the first to third clock signals CLA, CLB, and CLC, and image data RGB. Here, the synchronization signal includes a horizontal synchronization signal Hsync, a vertical synchronization signal Vsync, and a main clock signal MCLK.

The signal controller 150 divides the external input data InD by a frame unit according to the vertical synchronization signal Vsync. Also, the signal controller 150 divides the external input data InD by the scan line unit according to the horizontal synchronization signal Hsync to generate the image data RGB.

A horizontal period according to an exemplary embodiment of the present invention includes a writing period in which the red, green, and blue data signals are respectively stored in the capacitors Cr, Cg, and Cb and a scan period in which the red, green, and blue data signals respectively stored in the capacitors Cr, Cg, and Cb are transmitted to the corresponding data lines. The signal controller 150 transmits the first to third clock signals CLA, CLB, and CLC that are activated during the writing period to the data distribution unit 140.

The signal controller 150 may alternately output the first and second clock signals CLA and CLB during the writing period to not overlap the activation periods with each other. Also, the signal controller 150 may make the first clock signal CLA or the second clock signal CLB overlap the activation period of the third clock signal CLC (e.g., by a predetermined amount of time).

Figure 2:
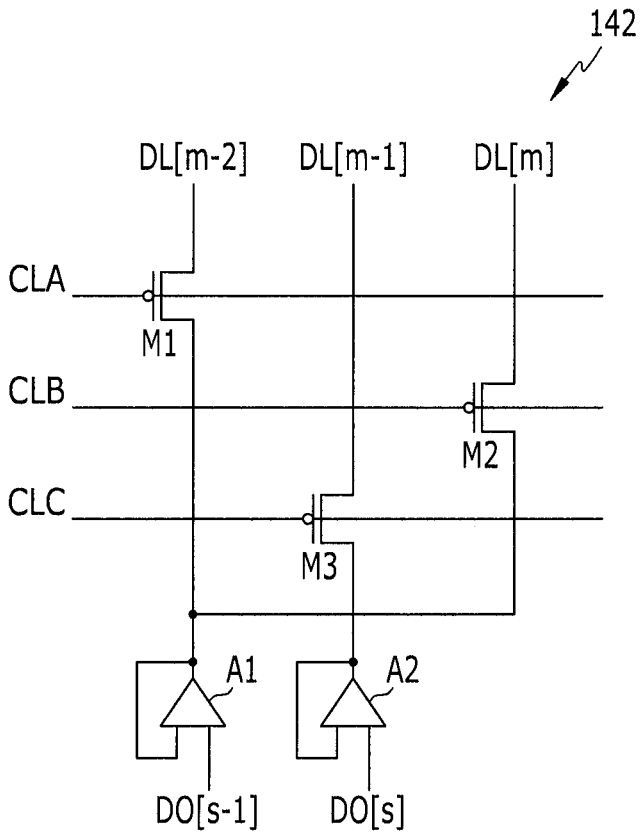
FIG. 2 is a schematic diagram according to an exemplary embodiment of the demultiplexer shown in FIG. 1.

FIG. 2 is a schematic diagram of the demultiplexer 142 shown in FIG. 1 according to an exemplary embodiment.

Referring to FIG. 2, the demultiplexer 142 according to an exemplary embodiment of the present invention includes first and second buffers A1 and A2 and first to third switches M1-M3. Here, the first to third switches M1-M3 include a PMOSFET as a p-channel-type transistor, and an exemplary embodiment of the present invention is not limited thereto.

The first buffer A1 is coupled to the output line DO[s−1] to buffer and output the data signal input through the output line DO[s−1]. The second buffer A2 is coupled to the output line DO[s] to buffer and output the data signal input through the output line DO[s].

The first switch M1 is coupled between the output terminal of the first buffer A1 and the data line DL[m−2] to be turned on by the first clock signal CLA. The second switch M2 is coupled between the output terminal of the first buffer A1 and the data line DL[m] to be turned on by the second clock signal CLB.

The third switch M3 is coupled between the output terminal of the second buffer A2 and the data line DL[m−1] to be turned on by the third clock signal CLC. That is, the red and blue data signals are sequentially transmitted to the data lines DL[m−2] and DL[m] through the output line DO[s−1] and the green data signal is transmitted to the data line DL[m−1] through the output line DO[s].

Figure 3:
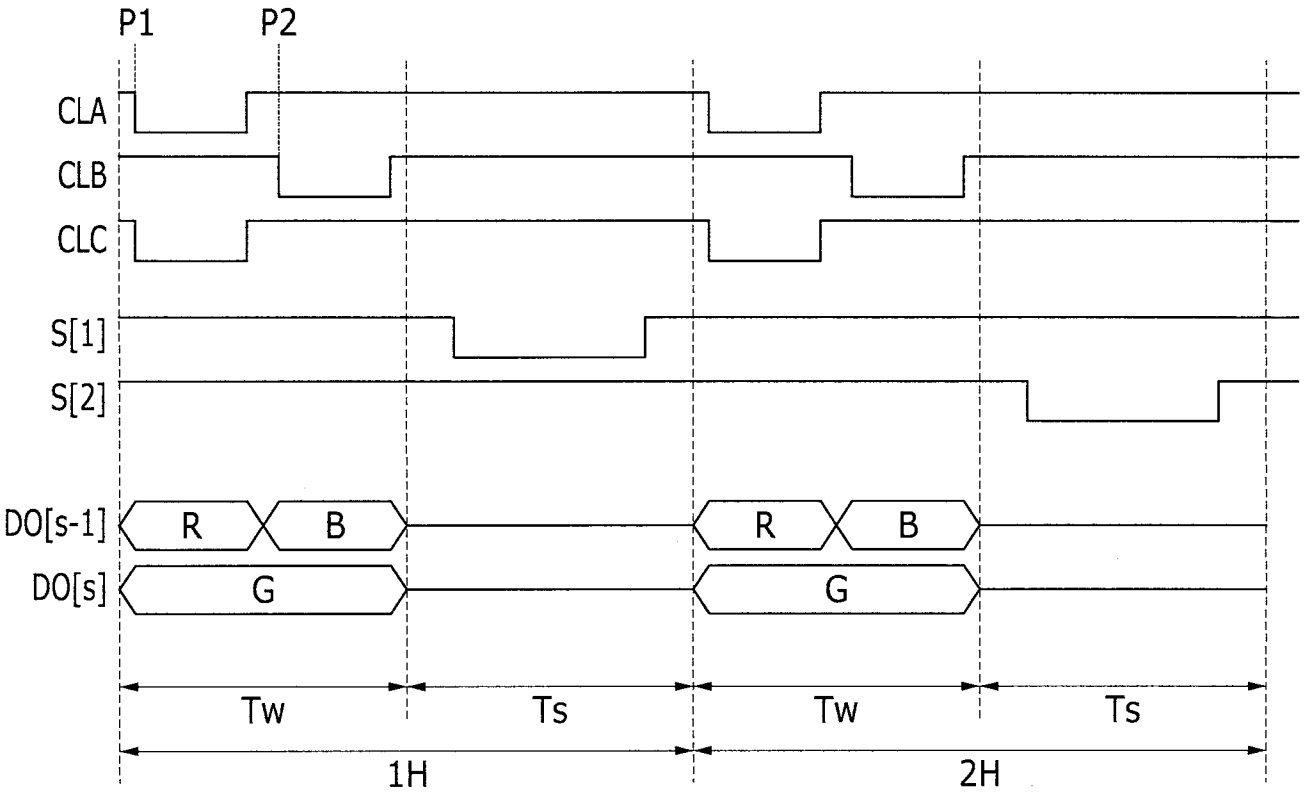
FIG. 3 is a timing diagram of a driving method of an organic light emitting diode (OLED) display according to a first exemplary embodiment of the present invention.

FIG. 3 is a timing diagram of a driving method of an organic light emitting diode (OLED) display according to the first exemplary embodiment of the present invention.

Referring to FIG. 3, firstly, the signal controller 150 activates and outputs the first clock signal CLA during the writing period Tw at P1. Thus, the switch M1 is turned on by the first clock signal CLA, and the output line DO[s−1] and the data line DL[m−2] are coupled.

At this time, the data driver 130 outputs the red data signal through the output line DO[s−1]. The output red data signal is transmitted to the data line DL[m−2] and the capacitor Cr is charged with the voltage corresponding to the red data signal.

Concurrently with the red data signal, (e.g., simultaneously), the signal controller 150 activates and outputs the third clock signal CLC. Thus, the switch M3 is turned on by the third clock signal CLC, and the output line DO[s] and the data line DL[m−1] are coupled. At this time, the data driver 130 outputs the green data signal through the output line DO[s]. The output green data signal is transmitted to the data line DL[m−1] and the capacitor Cg is charged with the voltage corresponding to the green data signal.

In this state, the signal controller 150 deactivates the first and third clock signals CLA and CLC and activates the second clock signal CLB at P2. Accordingly, the switches M1 and M3 are turned off and the switch M2 is turned on.

Thus, the output line DO[s−1] is coupled to the data line DL[m]. At this time, the data driver 130 outputs the blue data signal. The output blue data signal is transmitted to the data line DL[m−1] and the capacitor Cb is charged with the voltage corresponding to the blue data signal.

Next, the signal controller 150 deactivates the second clock signal CLB and the switch M2 is turned off. That is, during the writing period Tw, the red and blue data signals are sequentially written to the capacitors Cr and Cb, and the green data signal is concurrently (e.g., simultaneously) written to the capacitor Cg. Accordingly, by concurrently (e.g., simultaneously) writing two data signals during the ½ period of the writing period Tw, sufficient data writing time may be obtained.

Next, during the scan period Ts, the scan signal S[1] is supplied to the scan line SL[1]. Thus, the voltage charged to the capacitors Cr, Cg, and Cb is transmitted to the data lines coupled to the red, green, and blue subpixels R, G, and B, respectively. Accordingly, the red, green, and blue subpixels R, G, and B emit the light.

Likewise, during the writing period Tw of the next horizontal period 2H, the red data signal and green data signal are concurrently (e.g., simultaneously) written to the capacitors Cr and Cg, and the blue data signal is written to the capacitor Cb after the writing of the red data signal is completed. Also, the scan signal S[2] is supplied to the scan line SL[2] during the scan period Ts, and the voltage charged to the capacitors Cr, Cg, and Cb is transmitted to the data lines coupled to the red, green, and blue subpixels R, G, and B, respectively, such that the red, green, and blue subpixels R, G, and B emit light.

Figure 4:
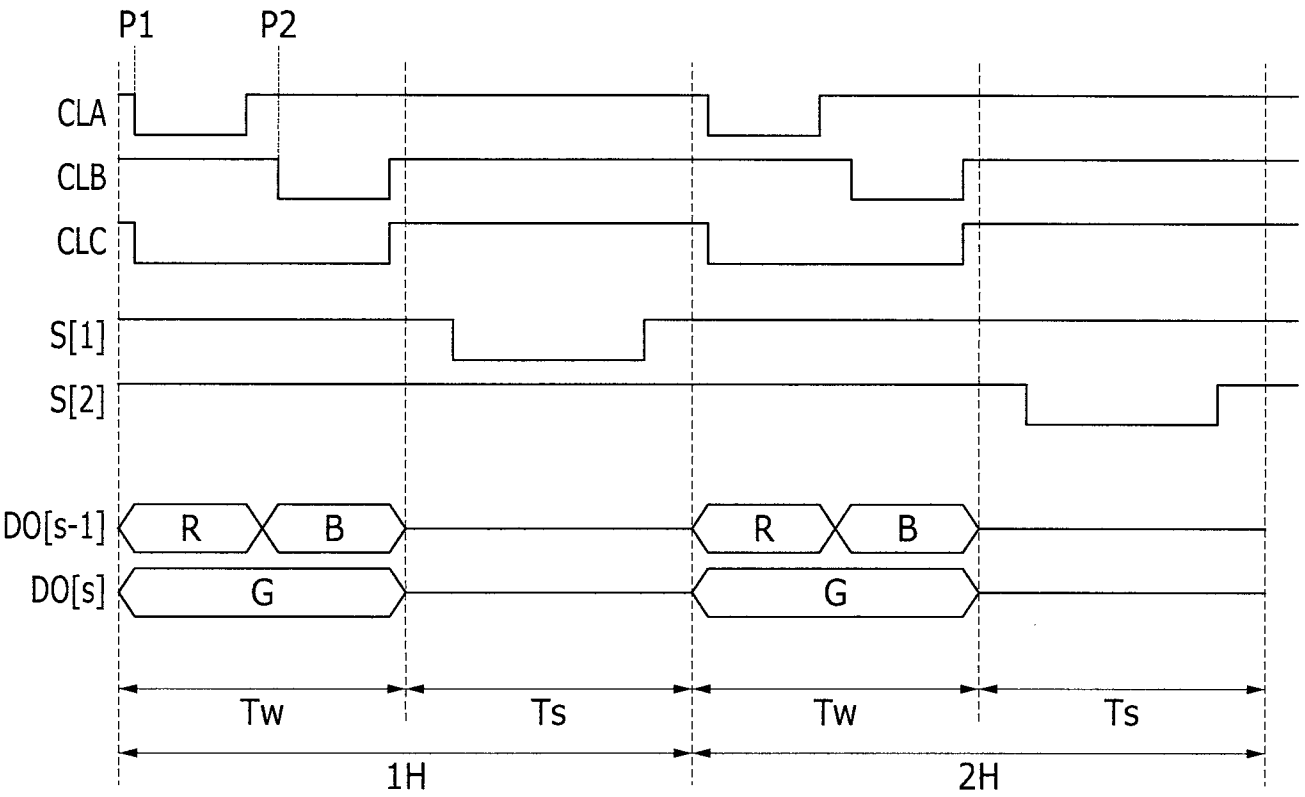
FIG. 4 is a timing diagram of a driving method of an organic light emitting diode (OLED) display according to a second exemplary embodiment of the present invention.

FIG. 4 is a timing diagram of a driving method of an organic light emitting diode (OLED) display according to a second exemplary embodiment of the present invention.

Referring to FIG. 4, the driving method according to the second exemplary embodiment of the present invention is different from the first exemplary embodiment shown in FIG. 3 in the point that the activation period of the third clock signal CLC overlaps the activation period of both the first clock signal CLA and the second clock signal CLB.

That is, the activation period of the third clock signal CLC is more than double the first clock signal CLA or the second clock signal CLB. Accordingly, the writing time of the green data signal may be obtained more than double the writing time of the red and blue data signals. For example, when the pixels PX are arranged with an R/G/B/G pentile structure such that a data loading time for the green subpixel G is relatively long, the writing time of the green data signal may be obtained by controlling the activation period of the third clock signal CLC.

Figure 5A:
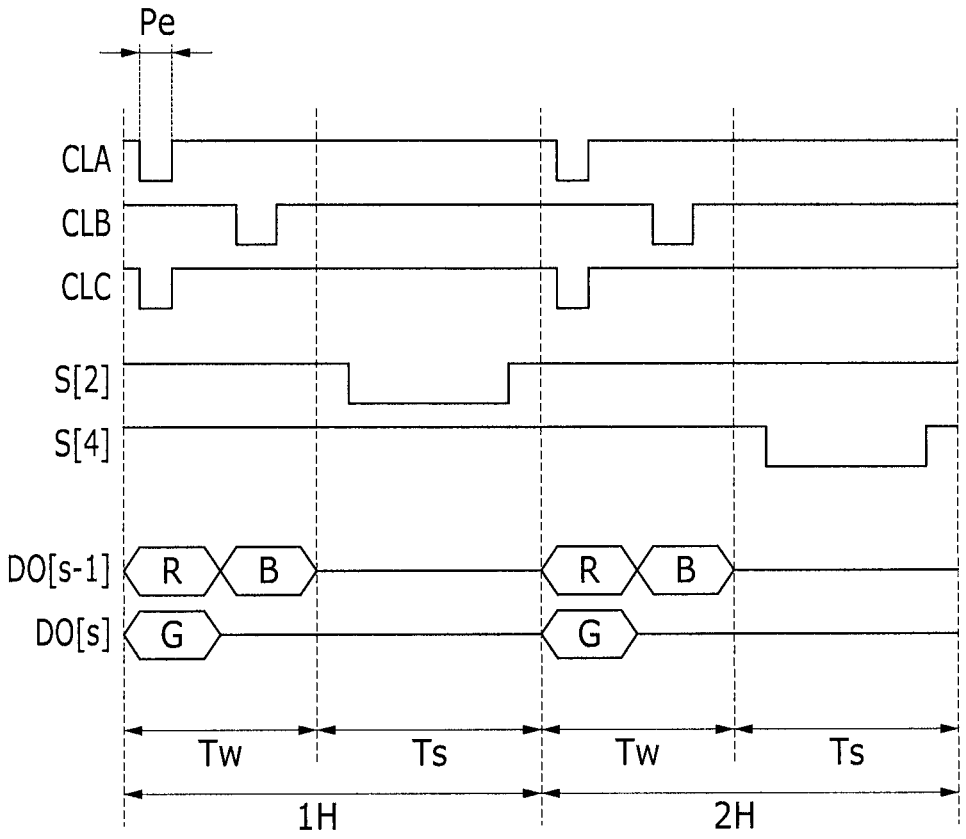
FIG. 5A and FIG. 5B are timing diagrams of a driving method of an organic light emitting diode (OLED) display according to a third exemplary embodiment of the present invention.
Figure 5B:
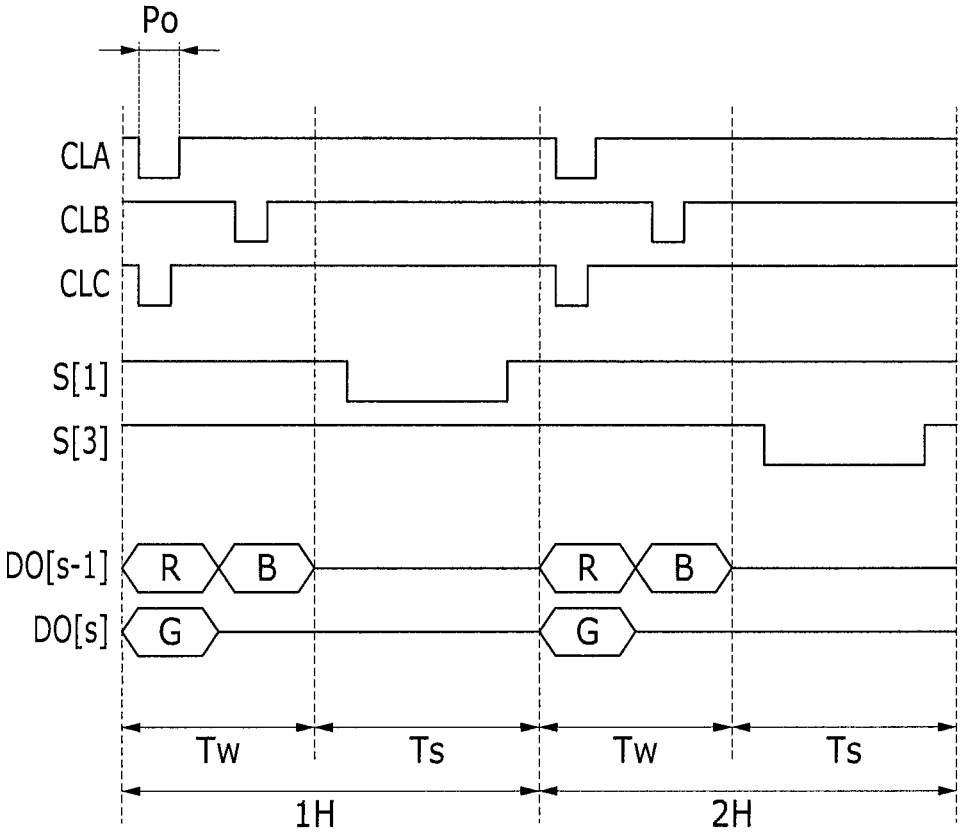

FIG. 5A and FIG. 5B are timing diagrams of a driving method of an organic light emitting diode (OLED) display according to a third exemplary embodiment of the present invention. FIG. 5A and FIG. 5B are views to explain a method of dividing one frame into an odd-numbered frame and an even-numbered frame and sequentially driving the odd-numbered frame and the even-numbered frame, where FIG. 5A shows the odd-numbered frame and FIG. 5B shows the even-numbered frame.

Referring to FIG. 5A and FIG. 5B, the scan driver 120 according to the third exemplary embodiment of the present invention sequentially supplies the scan signal corresponding to the even-numbered scan lines among the plurality of scan lines SL[1]-SL[n] and sequentially supplies the scan signal corresponding to the odd-numbered scan lines during one frame as two time operations. Here, the signal controller 150 may differently output the activation period Pe of the first clock signal CLA (or the second clock signal CLB) in the even-numbered frame from the activation period Po in the odd-numbered frame.

For example, the activation period Pe of the first clock signal CLA in the even-numbered frame may be determined to be larger than the activation period Po of the first clock signal CLA in the odd-numbered frame. Also, in the odd-numbered frame, the second clock signal CLB may be determined to be the same or substantially the same as the activation period Pe of the first clock signal CLA of the even-numbered frame, and may be determined to be the same or substantially the same as the activation period Po of the first clock signal CLA of the even-numbered frame in the odd-numbered frame. That is, in the even-numbered frame and the odd-numbered frame, the sum of the activation period of the first clock signal CLA and the sum of the activation period of the second clock signal CLB may be determined to be the same or substantially the same.

As described above, by sequentially writing the red data signal and the blue data signal during the writing period, the writing time of the red data signal (or the blue data signal) is relatively reduced such that the data writing time is increased (e.g., by a predetermined amount of time) in the even-numbered frame or the odd-numbered frame, thereby entirely increasing the time of writing the red data signal (or the blue data signal) during one frame compared with FIG. 3.

Figure 6:
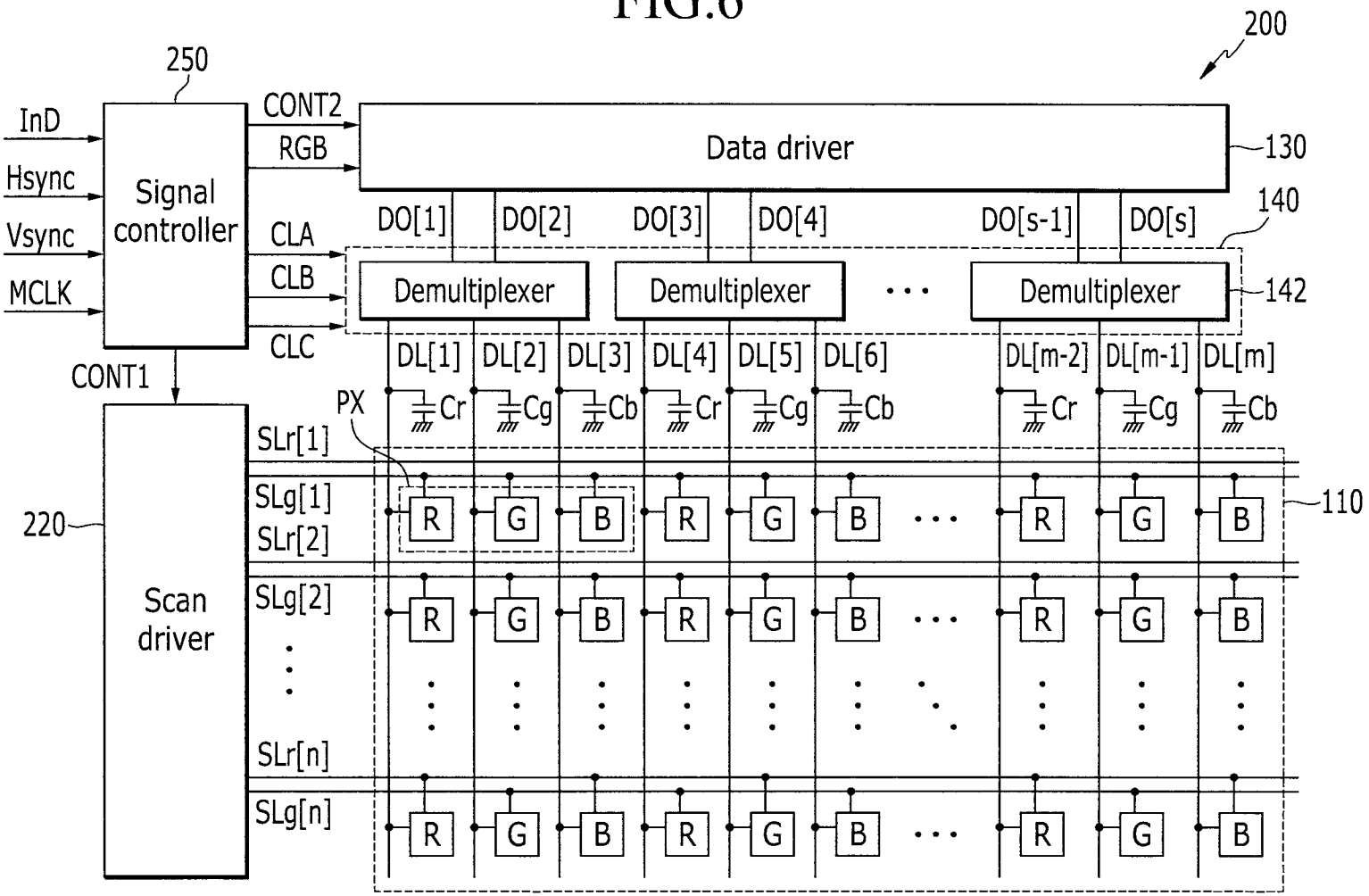
FIG. 6 is a view of an organic light emitting diode (OLED) display according to the second exemplary embodiment of the present invention.

FIG. 6 is a view of an organic light emitting diode (OLED) display according to the second exemplary embodiment of the present invention.

Referring to FIG. 6, an organic light emitting diode (OLED) display 200 according to the second exemplary embodiment of the present invention includes a display unit 110, a scan driver 220, a data driver 130, a data distribution unit 140, and a signal controller 250. Here, the display unit 110, the data driver 130, and the data distribution unit 140 are the same as those of FIG. 1 such that the same reference numerals are used for convenience of the description, and the detailed description is omitted.

The scan driver 220 generates a plurality of first and second scan signals Sr[1]-Sr[n] and Sg[1]-Sg[n] according to the first driving control signal CONT1. The scan driver 220 sequentially transmits a plurality of first and second scan signals Sr[1]-Sr[n] and Sg[1]-Sg[n] to first and second corresponding scan lines SLr[1]-SLr[n] and SLg[1]-SLg[n].

Here, the first scan lines SLr[1]-SLr[n] are coupled to the red and blue subpixels R and B of each pixel PX, and the second scan lines SLg[1]-SLg[n] are coupled to the green subpixel G. The scan driver 220 according to the second exemplary embodiment of the present invention may determines a longer scan-on time of the plurality of second scan signals Sg[1]-Sg[n] than that of the plurality of first scan signals Sr[1]-Sr[n].

The signal controller 250 transmits the first to third clock signals CLA, CLB, and CLC that are activated during the writing period to the data distribution unit 140. The signal controller 250 may alternately output the first and second clock signals CLA and CLB during the writing period, such that the activation period of the first and second clock signals CLA and CLG are not overlapped. Also, the signal controller 250 delays and outputs the third clock signal CLC rather than the first clock signal CLA (e.g., by a predetermined time).

The signal controller 250 delays and outputs the third clock signal CLC by a scan-on time difference between a plurality of the second scan signals Sg[1]-Sg[n] and a plurality of the first scan signals Sr[1]-Sr[n]. An exemplary embodiment of the present invention is not limited thereto, and when transmission timing of a plurality of the second scan signals Sg[1]-Sg[n] is faster than that of a plurality of the first scan signals Sr[1]-Sr[n], the signal controller 250 may activate and output the third clock signal CLC earlier than the first clock signal CLA. The activation period of the third clock signal CLC may be output to overlap the first clock signal CLA or the second clock signal CLB (e.g., by a predetermined amount of time).

Figure 7:
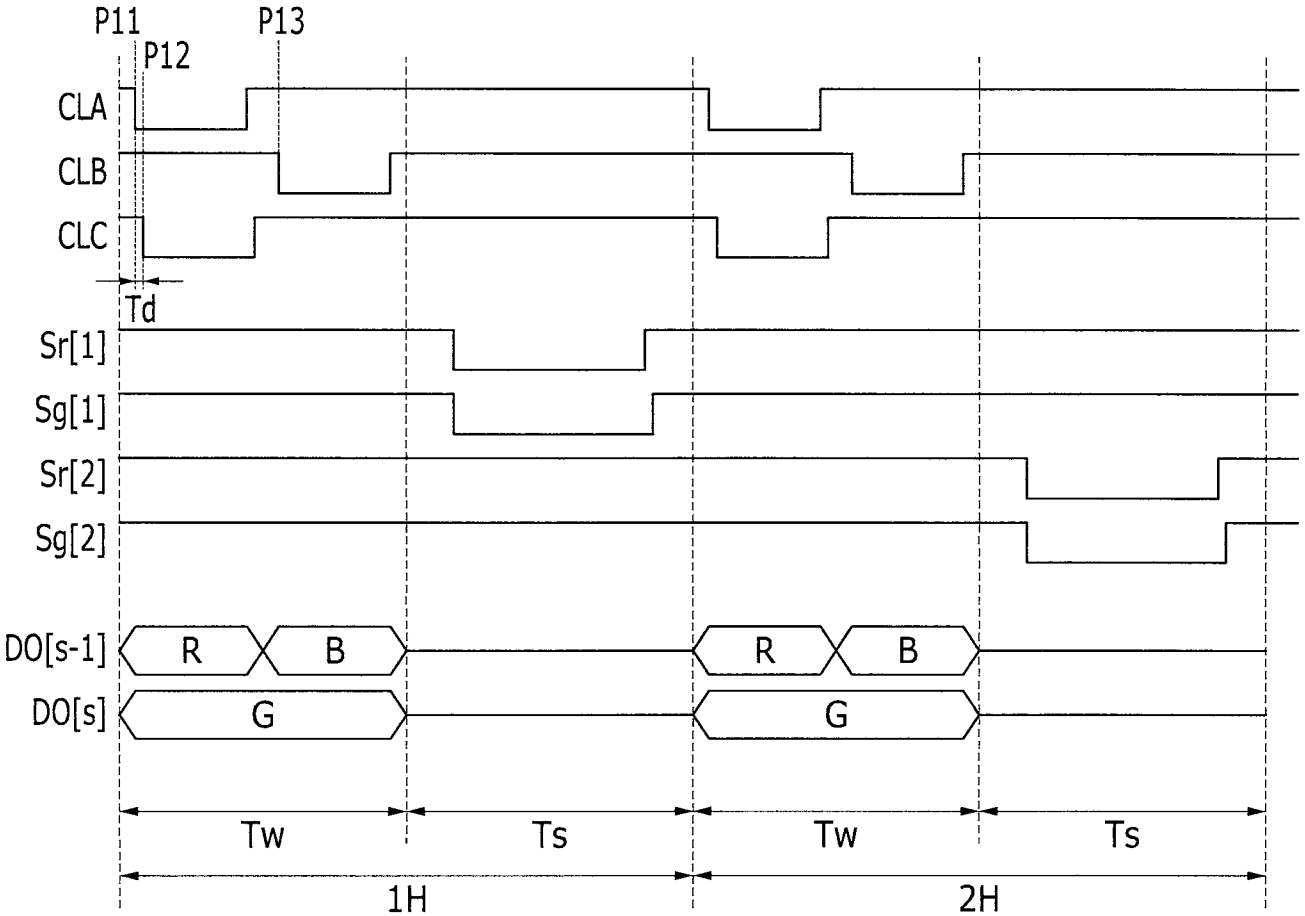
FIG. 7 is a timing diagram of a driving method of an organic light emitting diode (OLED) display according to a fourth exemplary embodiment of the present invention.

FIG. 7 is a timing diagram of a driving method of an organic light emitting diode (OLED) display according to a fourth exemplary embodiment of the present invention.

Referring to FIG. 7, firstly, the signal controller 150 activates and outputs the first clock signal CLA during the writing period Tw at P11. Thus, the switch M1 is turned on by the first clock signal CLA, and the output line DO[s−1] and the data line DL[m−2] are coupled.

At this time, the data driver 130 outputs the red data signal through the output line DO[s−1]. The output red data signal is transmitted to the data line DL[m−2] and the capacitor Cr is charged with the voltage corresponding to the red data signal.

Next, the signal controller 150 activates and outputs the third clock signal CLC at P12. Thus, the switch M3 is turned on by the third clock signal CLC and the output line DO[s] is coupled to the data line DL[m−1]. At this time, the data driver 130 outputs the green data signal through the output line DO[s]. The output green data signal is transmitted to the data line DL[m−1] and the capacitor Cg is charged with the voltage corresponding to the green data signal.

In this state, the signal controller 150 deactivates the first and third clock signals CLA and CLC and activates the second clock signal CLB at P13. Accordingly, the switches M1 and M3 are turned off and the switch M2 is turned on. Thus, the output line DO[s−1] is coupled to the data line DL[m].

At this time, the data driver 130 outputs the blue data signal. The output blue data signal is transmitted to the data line DL[m−1] and the capacitor Cb is charged with the voltage corresponding to the blue data signal. Next, the signal controller 150 deactivates the second clock signal CLB and the switch M2 is turned off.

Next, the scan signal Sr[1] is supplied to the scan line SLr[1] during the scan period Ts. Thus, the voltage charged to the capacitors Cr and Cb is transmitted to the data lines that are coupled to the red, and blue subpixels R and B. Concurrently with the scan signal Sr[1] (e.g., simultaneously), the scan signal Sg[1] is supplied to the scan line SLg[1]. Thus, the voltage charged to the capacitor Cg is transmitted to the data line coupled to the green subpixel G. At this time, the duration of the scan-on time of the scan signal Sg[1] is longer than the duration of the scan-on time of the scan signal Sr[1]. That is, the duration of the scan-on time for the green subpixel G is longer than that of the red and blue subpixels R and B such that a data compensation time for the green subpixel G in which the visibility for the spots is relatively high may be sufficiently obtained.

Also, after the scan of the scan line SLg[1] is completed during the writing period Tw of the next horizontal period 2H, the third clock signal CLC is delayed compared to the first clock signal CLA by an amount of time Td and is output such that a margin between the scan period and the writing period may be obtained. The time Td may be equal or substantially equal to the difference between a duration of the scan-on times of the scan signal Sr[1] and the scan signal Sg[1].

Figure 8:
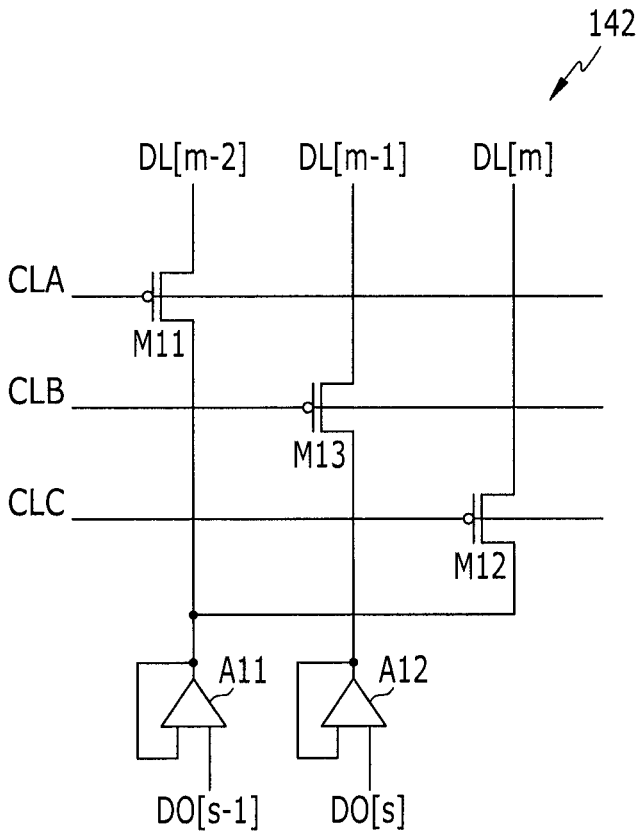
FIG. 8 is a schematic diagram of the demultiplexer shown in FIG. 1 according to another exemplary embodiment.

FIG. 8 is a schematic diagram of the demultiplexer 142 shown in FIG. 1 according to another exemplary embodiment.

Referring to FIG. 8, the demultiplexer 142 according to the current exemplary embodiment of the present invention includes first and second buffers A11 and A12 and first to third switches M11-M13. Here, the first to third switches M11-M13 include the PMOSFET as the p-channel-type transistor, and an exemplary embodiment of the present invention is not limited thereto.

The first buffer A11 is coupled to the output line DO[s−1] to buffer and output the data signal input through the output line DO[s−1]. The second buffer A12 is coupled to the output line DO[s] to buffer and output the data signal input through the output line DO[s].

The first switch M11 is coupled between the output terminal of the first buffer A11 and the data line DL[m−2] to be turned on by the first clock signal CLA. The second switch M2 is coupled between the output terminal of the first buffer A11 and the data line DL[m] to be turned on by the third clock signal CLC.

The third switch M13 is coupled between the output terminal of the second buffer A12 and the data line DL[m−1] to be turned on by the second clock signal CLB. That is, the red and green data signals are sequentially transmitted to the data lines DL[m−2] and DL[m] through the output line DO[s−1], and the blue data signal is transmitted to the data line DL[m−1] through the output line DO[s].

Figure 9:
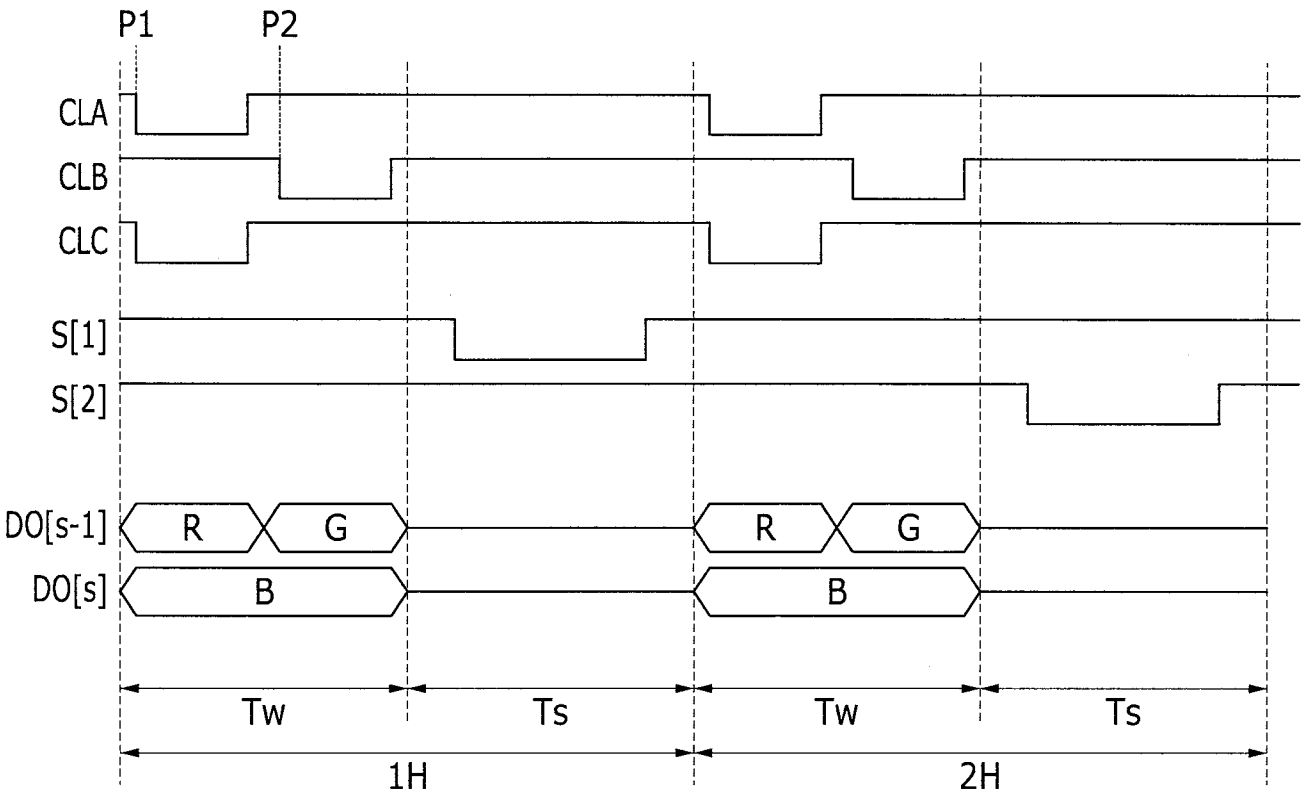
FIG. 9 is a timing diagram of a driving method of an organic light emitting diode (OLED) display according to a fifth exemplary embodiment of the present invention.

FIG. 9 is a timing diagram of a driving method of an organic light emitting diode (OLED) display according to the fifth exemplary embodiment of the present invention, and is a case of applying the demultiplexer 142 shown in FIG. 8.

Referring to FIG. 9, in the driving method according to the fifth exemplary embodiment of the present invention, the red and green data signals are sequentially output. That is, differently from the driving method described in FIG. 3, the red data signal and the blue data signal are concurrently (e.g., simultaneously) output and the green data signal is output after the red data signal is output.

Figure 10:
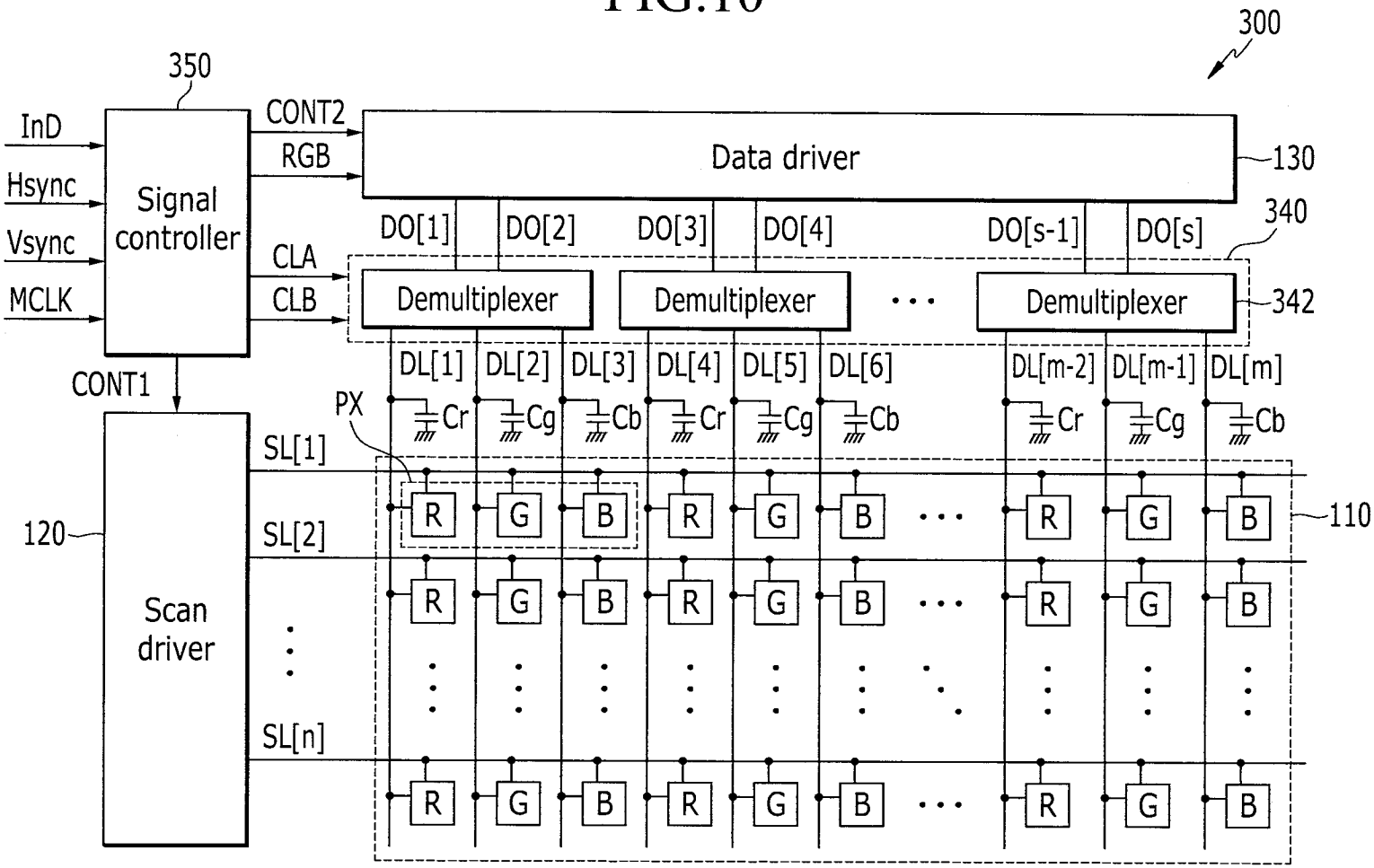
FIG. 10 is a view of an organic light emitting diode (OLED) display according to the third exemplary embodiment of the present invention.

FIG. 10 is a view of an organic light emitting diode (OLED) display according to the third exemplary embodiment of the present invention.

Referring to FIG. 10, an organic light emitting diode (OLED) display 300 according to the first exemplary embodiment of the present invention includes a display unit 110, a scan driver 120, a data driver 130, a data distribution unit 340, and a signal controller 350. Here, the display unit 110, the scan driver 120, and the data driver 130 are the same as those of FIG. 1 such that the same reference numerals are used for convenience of description, and the detailed description is omitted.

The data distribution unit 340 receives the first and second clock signal CLA and CLB from the signal controller 350 and respectively transmits a plurality of data signals D[1]-D[m] transmitted through the output lines DO[1]-DO[s] of the data driver 130 to a plurality of data lines DL[1]-DL[m]. Here, the plurality of data lines DL[1]-DL[m] include the capacitors Cr, Cg, and Cb to store the voltages corresponding to the red, green, and blue data signals.

The data distribution unit 340 includes a plurality of demultiplexers 342 transmitting three data signals transmitted from two output lines of the data driver 130 to the red, green, and blue subpixels R, G, and B, respectively. Here, the demultiplexers 342 are respectively coupled between two output lines DO[s−1] and DO[s] and three data lines DL[m−2], DL[m−1], and DL[m], and sequentially couple the output line DO[s−1] to the data lines DL[m−2] and DL[m] according to the first and second clock signals CLA and CLB.

The signal controller 350 transmits the first and second clock signals CLA and CLB to the data distribution unit 340 during the writing period. Here, the signal controller 350 alternately outputs the first and second clock signals CLA and CLB during the writing period, and the activation periods of the first and second clock signals CLA and CLB may be output to not overlap each other.

Figure 11:
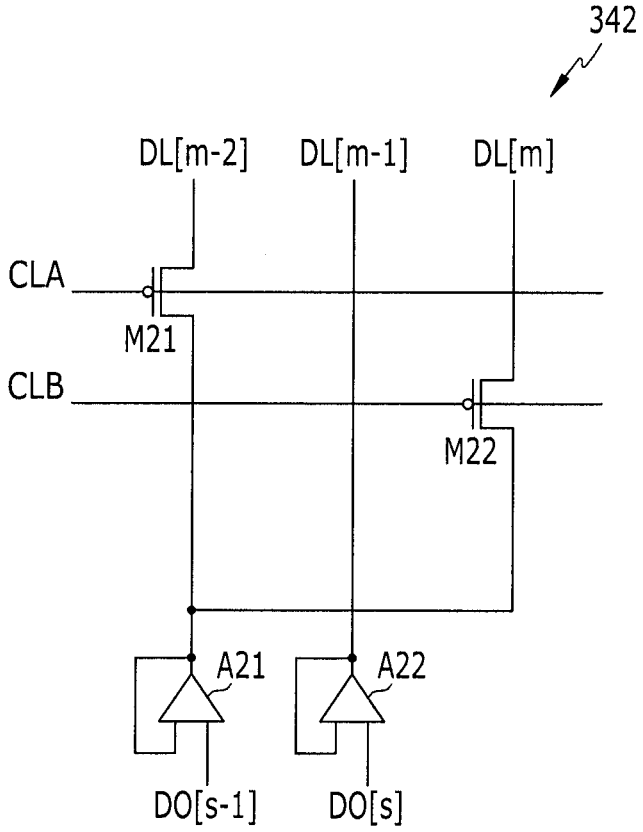
FIG. 11 is a schematic diagram of the demultiplexer shown in FIG. 10.

FIG. 11 is a schematic diagram of the demultiplexer 342 of FIG. 10 according to an exemplary embodiment.

Referring to FIG. 11, the demultiplexer 342 according to an exemplary embodiment of the present invention includes first and second buffers A21 and A22 and first and second switches M21 and M22. Here, the first and second switches M21 and M22 include the PMOSFET as the p-channel-type transistor, and an exemplary embodiment of the present invention is not limited thereto. The first buffer A21 is coupled to the output line DO[s−1] to buffer and output the data signal input through the output line DO[s−1]. The second buffer A22 is coupled to the output line DO[s] to buffer and output the data signal input through the output line DO[s].

The first switch M21 is coupled between the output terminal of the first buffer A21 and the data line DL[m−2] to be turned on by the first clock signal CLA. The second switch M22 is coupled between the output terminal of the first buffer A21 and the data line DL[m] to be turned on by the second clock signal CLB.

Accordingly, the red and blue data signals are sequentially transmitted to the data lines DL[m−2] and DL[m] through the output line DO[s−1], and the green data signal is transmitted to the data line DL[m−1] through the output line DO[s]. That is, the demultiplexer 342 according to the present exemplary embodiment of the present invention does not receive a separate clock signal for the output line DO[s] without the change of the data signal, and transmits the output of the data driver 130 to the data line DL[m] as it is.

Figure 12:
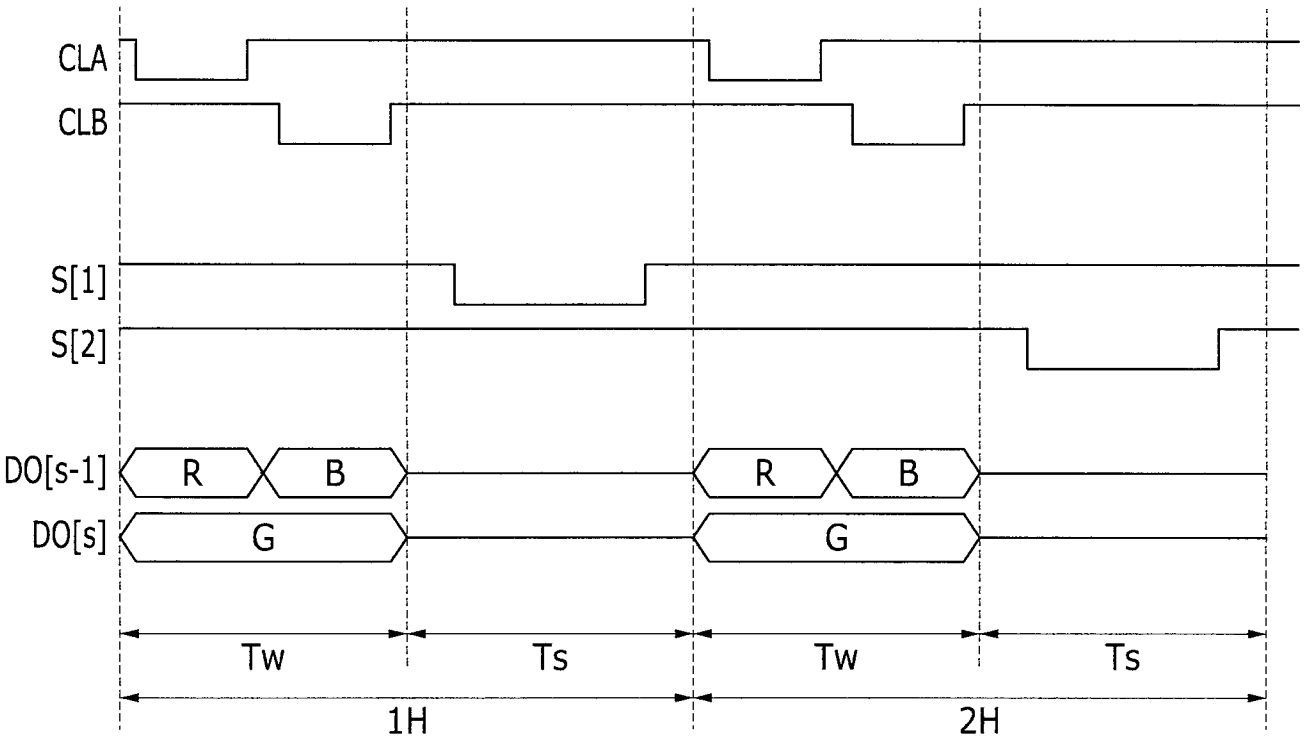
FIG. 12 is a timing diagram of a driving method of an organic light emitting diode (OLED) display according to a sixth exemplary embodiment of the present invention.

FIG. 12 is a timing diagram of a driving method of an organic light emitting diode (OLED) display according to the sixth exemplary embodiment of the present invention as a case of applying the demultiplexer 342 shown in FIG. 11.

Referring to FIG. 12, firstly, the switch M21 is turned on by the first clock signal CLA, and the output line DO[s−1] and the data line DL[m−2] are coupled. At this time, the data driver 130 outputs the red data signal through the output line DO[s−1]. Thus, the red data signal is transmitted to the data line DL[m−2].

Simultaneously, the green data signal is output through the output line DO[s] from the data driver 130, is buffered by the second buffer A22, and is transmitted to the data line DL[m−1].

Next, the first clock signal CLA is deactivated such that the switch M21 is turned off, and the switch M22 is turned on by the second clock signal CLB such that the output line DO[s−1] is coupled to the data line DL[m]. At this time, the data driver 130 outputs the blue data signal through the output line DO[s−1]. Thus, the blue data signal is transmitted to the data line DL[m].

Next, the data signal output to the data lines DL[m−2], and DL[m−1], and DL[m] is charged to the capacitors Cr, Cg, and Cb. During the scan period Ts, the scan signals S[1]-S[n] are sequentially supplied to a plurality of scan lines SL[1]-SL[n]. Thus, the data signal charged to the capacitors Cr, Cg, and Cb is transmitted to the red, green and blue subpixels R, G, and B of the pixel PX coupled to each of the scan lines SL[1]-SL[n]. Accordingly, the red, green, and blue subpixels R, G, and B emit light.

Likewise, the red data signal and the green data signal are also written with the same timing during the next horizontal period 2H, and the blue data signal is sequentially written after the red data signal is written.

Figure 13:
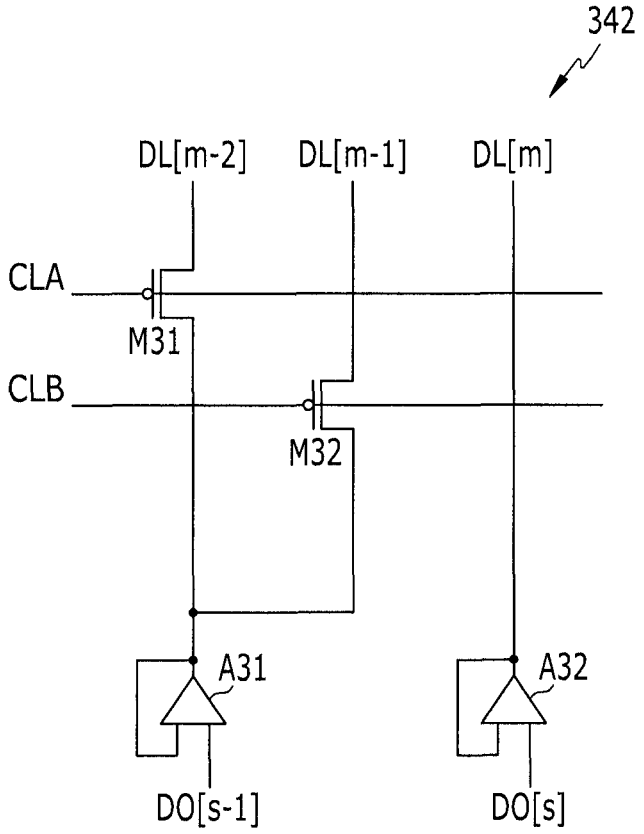
FIG. 13 is a schematic diagram of the demultiplexer shown in FIG. 10 according to another exemplary embodiment.

FIG. 13 is a schematic diagram of the demultiplexer 342 of FIG. 10 according to another exemplary embodiment.

Referring to FIG. 13, the demultiplexer 342 according to another exemplary embodiment of the present invention includes first and second buffers A31 and A32 and first and second switches M31 and M32. Here, the first and second switches M31 and M32 include the PMOSFET of the p-channel-type transistor, and an exemplary embodiment of the present invention is not limited thereto. The first buffer A31 is coupled to the output line DO[s−1] such that the data signal input through the output line DO[s−1] is buffered and output. The second buffer A32 is coupled to the output line DO[s] such that the data signal input through the output line DO[s] is buffered and output.

The first switch M31 is coupled between the output terminal of the first buffer A31 and the data line DL[m−2] and is turned on by the first clock signal CLA. The second switch M32 is coupled between the output terminal of the first buffer A31 and the data line DL[m−1] and is turned on by the second clock signal CLB. Accordingly, the red and green data signals are sequentially transmitted to the data lines DL[m−2] and DL[m−1] through the output line DO[s−1] and the blue data signal is transmitted to the data line DL[m] through the output line DO[s].

Figure 14:
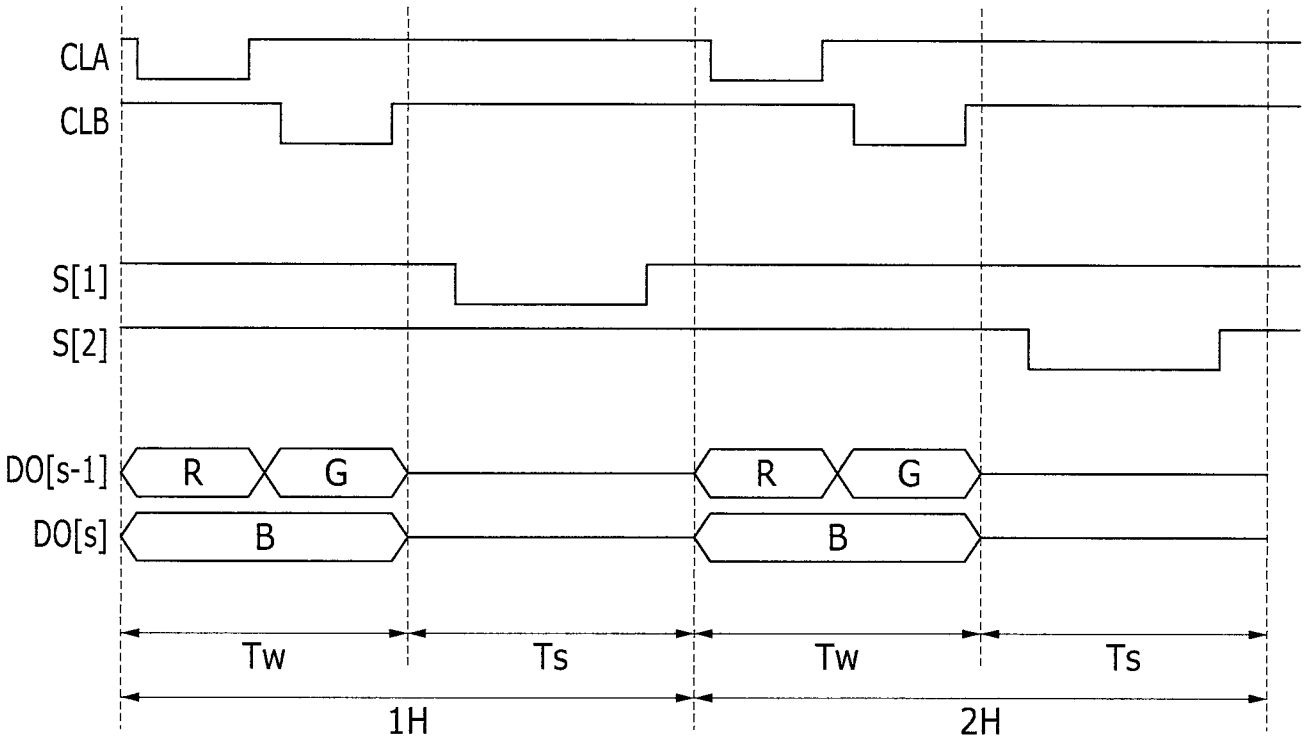
FIG. 14 is a timing diagram of a driving method of an organic light emitting diode (OLED) display according to a seventh exemplary embodiment of the present invention.

FIG. 14 is a timing diagram of a driving method of an organic light emitting diode (OLED) display according to the seventh exemplary embodiment of the present invention as a case of applying the demultiplexer 342 shown in FIG. 13.

Referring to FIG. 14, the driving method according to the seventh exemplary embodiment of the present invention sequentially outputs the red and green data signals. That is, differently from the driving method shown in FIG. 12, the red data signal and the blue data signal are concurrently (e.g., simultaneously) output, and the green data signal is output after the red data signal is output.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, and their equivalents.

DESCRIPTION OF SOME OF THE REFERENCE NUMERALS

110: display unit
120, 220: scan driver
130: data driver
140, 240, 340: data distribution unit
150, 250, 350: signal controller

What is claimed is:

1. An organic light emitting diode (OLED) display comprising:

a display unit comprising a plurality of data lines, a plurality of scan lines, and a plurality of pixels coupled to corresponding data lines of the data lines and corresponding scan lines of the scan lines;

a scan driver configured to supply a plurality of scan signals to the scan lines;

a data driver configured to:

output a plurality of first data signals among a plurality of data signals through a plurality of first output lines among a plurality of output lines, output a plurality of second data signals among the data signals through the first output lines, and output a plurality of third data signals among the data signals through a plurality of second output lines among the output lines, wherein the first data signals represent a first color, the second data signals represent a second color, and the third data signals represent a third color; and a data distribution unit configured to:

transmit the first data signals from the data driver to a plurality of corresponding first data lines among the data lines according to a first clock signal, transmit the second data signals from the data driver to a plurality of corresponding second data lines among the data lines according to a second clock signal, and transmit the third data signals from the data driver to a plurality of corresponding third data lines among the data lines according to a third clock signal output concurrently with the first clock signal, wherein a horizontal period comprises:

a writing period in which a corresponding voltage of the first to third data signals are respectively stored in first to third capacitive elements, a scan period in which the corresponding voltage of the first to third data signals stored in the first to third capacitive elements are transmitted to the corresponding data lines, and the scan driver supplies a corresponding scan signal of the plurality of scan signals to a corresponding scan line of the scan lines in the scan period.

2. The OLED display of claim 1, wherein the data driver is further configured to:

sequentially output the first data signal and the second data signal during the writing period, and output the third data signal to overlap with at least one of the first data signal or the second data signal.

3. The OLED display of claim 2, further comprising a signal controller configured to output the first and second clock signals having sequential activation periods, respectively, during the writing period.

4. The OLED display of claim 3, wherein the signal controller is configured to output the first clock signal and the second clock signal such that an activation period of the first clock signal does not overlap with an activation period of the second clock signal.

5. The OLED display of claim 3, wherein each frame comprises an even-numbered frame and an odd-numbered frame, and the signal controller is configured to output the first clock signal having an activation period of the even-numbered frame that is different from and an activation period of the odd-numbered frame.

6. The OLED display of claim 5, wherein the signal controller is configured to output the second clock signal having an activation period of the even-numbered frame that is different from an activation period of the odd-numbered frame.

7. The OLED display of claim 3, wherein the signal controller is configured to output the third clock signal having an activation period overlapping an activation period of at least one of the first clock signal and the second clock signal during the writing period.

8. The OLED display of claim 7, wherein the data distribution unit is configured to transmit the third data signal to the third data lines according to the third clock signal.

9. The OLED display of claim 8, wherein the data distribution unit comprises first and second switches configured to be turned on according to the first and second clock signals, respectively, to selectively couple the first output line to one of the corresponding first and second data lines.

10. The OLED display of claim 9, wherein the data distribution unit comprises a third switch configured to be turned on according to the third clock signal to selectively couple the second output line to the corresponding third data line.

11. The OLED display of claim 7, wherein each of the pixels comprises:

a first subpixel configured to emit light according to the first data signal, a second subpixel configured to emit light according to the second data signal, and a third subpixel configured to emit light according to the third data signal; and a plurality of scan lines comprising:

a plurality of first scan lines coupled to the first and second subpixels, and a plurality of second scan lines coupled to the third subpixel.

12. The OLED display of claim 11, wherein the third subpixel is configured to emit a green-colored light, and the scan driver is configured to output a scan-on period of a second scan signal supplied to the second scan line, wherein the scan-on period of the second scan signal is longer than a scan-on period of a first scan signal supplied to the first scan line.

13. The OLED display of claim 12, wherein the signal controller is configured to delay the activation period of the third clock signal with respect to the activation period of the first clock signal by a difference between a duration of the scan-on period of the first scan signal and a duration of the scan-on period of the second scan signal.

14. A method of driving an organic light emitting diode (OLED) display, the OLED display comprising:

a display unit comprising:

a plurality of data lines, a plurality of scan lines, and a plurality of pixels coupled to corresponding ones of the data lines and corresponding ones of the scan lines, a scan driver configured to supply a plurality of scan signals to the scan lines, and a data driver configured to output a plurality of data signals respectively corresponding to the pixels to a plurality of output lines, the method comprising:

sequentially outputting a first data signal representing a first color and a second data signal representing a second color to first output lines among the plurality of output lines;

outputting a third data signal representing a third color to second output lines among the plurality of output lines;

transmitting the first data signal from the data driver to first data lines among the plurality of data lines according to a first clock signal;

transmitting the second data signal from the data driver to second data lines among the plurality of data lines according to a second clock signal; and transmitting the third data signal from the data driver to third data lines among the plurality of data lines according to a third clock signal output concurrently with the first clock signal, wherein a horizontal period comprises:

a writing period in which a corresponding voltage of the first to third data signals are respectively stored in first to third capacitive elements, a scan period in which the corresponding voltage of the first to third data signals stored in the first to third capacitive elements are transmitted to the corresponding data lines, and the scan driver supplies a corresponding scan signal of the plurality of scan signals to a corresponding scan line of the scan lines in the scan period.

15. The method of claim 14, wherein the third data signal overlaps with one of the first and second data signals.

16. The method of claim 14, wherein the method further comprises outputting the first and second clock signals such that the first and second clock signals have sequential activation periods, respectively, during the writing period.

17. The method of claim 16, wherein in the outputting of the first and second clock signals, activation periods of the first and second clock signals do not overlap each other.

18. The method of claim 16, further comprising outputting the third clock signal comprising an activation period that overlaps an activation period of one of the first and second clock signals during the writing period.

19. An organic light emitting diode (OLED) display comprising:

a display unit comprising a first data line, a second data line, a third data line, and a plurality of pixels coupled to corresponding data lines of the first data line, the second data line, the third data line;

a data driver configured to:

output a first data signal through a first output line, output a second data signal through the first output line, output a third data signal through a second output line; and a data distribution unit configured to:

transmit the first data signal from the data driver to the first data line according to a first clock signal, transmit the second data signal from the data driver to the second data line according to a second clock signal, and transmit the third data signal from the data driver to the third data line, wherein one of the first data line and the second data line is coupled to the first output line according to the first clock signal and the second clock signal, and the third data line is coupled to the second output line wherein a horizontal period comprises:

a writing period in which a corresponding voltage of the first to third data signals are respectively stored in first to third capacitive elements, a scan period in which the corresponding voltage of the first to third data signals stored in the first to third capacitive elements are transmitted to the corresponding data lines, and a scan driver supplies a corresponding scan signal of a plurality of scan signals to a corresponding scan line of the scan lines in the scan period.

* * * * *